US007330116B2

(12) United States Patent
Prat et al.

(10) Patent No.: US 7,330,116 B2
(45) Date of Patent: Feb. 12, 2008

(54) STICKER-TYPE SHOPLIFTING-PREVENTION SECURITY DEVICE

(76) Inventors: Lionel Prat, 62, Rue des Abbesses, Chelles (FR) F-77500; Patrice Coupin, 42, Rue du Rond Point, Gagny (FR) F-93220

( * ) Notice: Subject to any disclaimer, the term of this patent is extended or adjusted under 35 U.S.C. 154(b) by 232 days.

(21) Appl. No.: 10/537,675

(22) PCT Filed: Nov. 21, 2003

(86) PCT No.: PCT/FR03/03454

§ 371 (c)(1),
(2), (4) Date: Jun. 6, 2005

(87) PCT Pub. No.: WO2004/061790

PCT Pub. Date: Jul. 22, 2004

(65) Prior Publication Data

US 2006/0022828 A1 Feb. 2, 2006

(30) Foreign Application Priority Data

Dec. 6, 2002 (FR) ..... 02 15406

(51) Int. Cl.
*G08B 23/00* (2006.01)
*G08B 13/14* (2006.01)

(52) U.S. Cl. ..... 340/572.1; 340/571; 340/572.3; 340/572.4; 340/568.1

(58) Field of Classification Search ..... None
See application file for complete search history.

(56) References Cited

U.S. PATENT DOCUMENTS 5,012,225 A * 4/1991 Gill ..... 340/572.3
2004/0046665 A1* 3/2004 Narlow et al. ..... 340/572.3

FOREIGN PATENT DOCUMENTS

EP 0 762 353 3/1997

* cited by examiner

*Primary Examiner*—Julie Bichngoc Lieu
(74) *Attorney, Agent, or Firm*—Young & Thompson

(57) ABSTRACT

A shoplifting-prevention security device includes a flexible flat substrate (1) having an inductor (2) and a capacitor (3) which form a resonant circuit, the plates of the capacitor being separated by a layer of dielectric material. Moreover, at least one zone (A) of the material can be used to establish a short circuit between the plates in order to deactivate the device. In addition, at least one face of the above-mentioned substrate is provided with a rigid part (B) having a contour (Bc) which surrounds the zone(s) (A) provided for the purpose of deactivation.

19 Claims, 2 Drawing Sheets

STICKER-TYPE SHOPLIFTING-PREVENTION SECURITY DEVICE

BACKGROUND OF THE INVENTION

The invention pertains to a security device for preventing shoplifting consisting of a flexible flat substrate comprising an inductor and a capacitor which form a resonant circuit, the plates of the capacitor being separated by a layer of dielectric material at least one zone of which is designed to make it possible to establish a short-circuit between the plates for a deactivation of the device.

A security device of this kind very often takes the form of a sticker, for example square or rectangular, of a reduced thickness, of the order of a few tenths of a millimeter. This supple security device is designed to be integrated in an invisible manner into products or objects displayed for sale on shop shelves.

In particular, such security devices are used as antitheft protection for shoes and are inserted between two layers of the sole.

When the security device has not been deactivated, the resonant circuit formed by the capacitor and the inductor is in the operating state. When an object fitted with the device passes through the field of action of a detection apparatus, an alarm is triggered.

On the other hand, when the security device has been deactivated, for example at the time of payment for the object, the consumer can cross the zone of action of the detection apparatuses without causing triggering.

The deactivation of the security device is generally obtained by subjecting it to a pulsed emission which, in the zone or zones provided for this purpose of the dielectric layer, causes the establishment of a short-circuit between the plates of the capacitor so that the resonant circuit is no longer operative.

However, it is apparent that such deactivation does not exhibit sufficient reliability. In particular, in the case of shoes, the short-circuit effected by the electrical link between the plates of the capacitor may disappear through breakage of this electrical link when the consumer walks with the shoes. The zone of the sole where the security device is located is in fact subjected to repeated bendings that may provoke the breakage of the electrical link. In the case of such a breakage, the consumer having properly purchased the shoes that he is wearing will trigger an alarm on entering a shop equipped with a detection device for preventing shoplifting. Such untoward triggering is a source of unjustified nuisance for the consumer and should be avoided.

The example has been provided in relation to shoes, but it is clear that other objects or products, equipped with stickers of the kind in question, may be involved.

SUMMARY OF THE INVENTION

The invention is therefore aimed above all, at providing a security device for preventing shoplifting which no longer exhibits, or exhibits to a lesser degree, the drawbacks mentioned above, and which makes it possible to obtain reliable deactivation of the device, while remaining simple and economical.

According to the invention, a security device for preventing shoplifting, of the sticker type, as defined previously is characterized in that on one face at least of the substrate is provided a rigidified part whose contour surrounds the zone or zones provided for deactivation.

A rigidified part may be provided on each face of the substrate, the contour of each rigidified part surrounding the zone or zones provided for deactivation.

The rigidity of the rigidified part is such that the repeated bending movements of the flexible substrate are prevented or limited in the zone or zones where the short-circuits have been, or will be, established. The electrical short-circuit links are thus protected against breakage.

The rigidified part may be constituted by a region of the substrate itself having undergone a rigidification treatment or having a specific composition endowing it with greater rigidity, or by an add-on rigidification element fixed to the substrate.

The add-on rigidification element may be made of resin, or of composite resin hardened when cold or under ultraviolet radiation.

The rigidification element may also be constituted by a ring or a rigid panel, for example made of metal or insulating material, in particular hard plastic. The panel may be flat, or domed, possibly pierced at its center. The ring or the panel may be honed on its periphery.

Preferably, a rigidification element is fixed on each face of the flat element, on either side of the zone or zones provided for deactivation.

Advantageously, the sticker has a contour of ovoid form with one end narrower than the other, and the capacitor plates are provided toward the narrower end. Such a sticker may be inserted into the toe of the sole of a shoe, in front of the zone of natural creasing when walking; the sticker is then less stressed in bending and the risk of undesired reactivation is yet more reduced. The detection and the incorporation into the shoe are optimized, and a guard distance, preferably of at least 2 cm (two centimeters), is preserved between the edge of the sticker and the edge of the shoe, for gluing between insole and sole.

BRIEF DESCRIPTION OF THE DRAWINGS

The invention consists, apart from the provisions set forth hereinabove, of a certain number of other provisions that will be dealt with more explicitly hereinafter in relation to exemplary embodiments described in detail with reference to the appended drawings, but which are in no way limiting.

In these drawings.

DETAILED DESCRIPTION OF THE PREFERRED EMBODIMENTS

Figure 1:
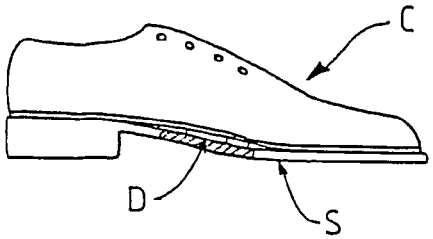
FIG. 1 is a diagrammatic view, with cutaway part, of a shoe whose sole is equipped with a security device for preventing shoplifting.

Referring to FIG. 1, there may be seen a shoe C furnished with a security device D for preventing shoplifting. The device D of the sticker type is inserted and glued between two layers of the sole S of the shoe. The thickness of the device D is small, a few tenths of a millimeter, so that its presence in the sole is not inconvenient and is not perceptible.

Of course, products other than shoes may be equipped in the same manner, for example books or clothes.

Figure 2:
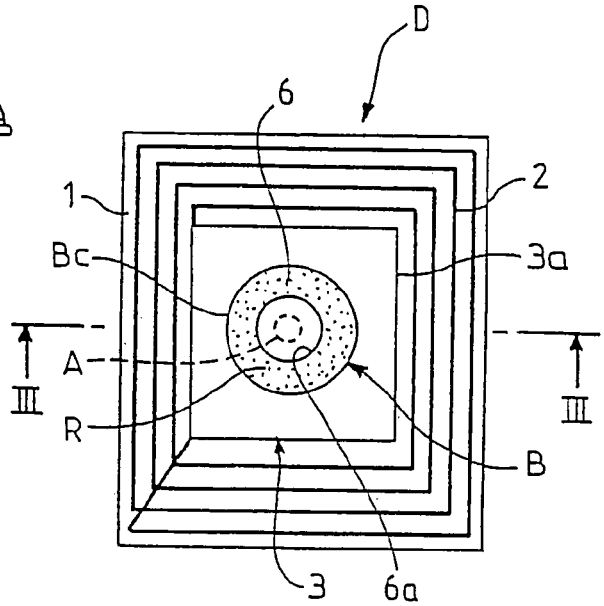
FIG. 2 is a plan view on a larger scale of the security device according to the invention.

As visible in FIG. 2, the device D consists of a flat flexible substrate 1, for example square with a side of a few centimeters, in particular of the order of 5 cm. The substrate is advantageously constituted of a multilayer flexible film of plastic and aluminum. The device D comprises an inductor 2 formed by flat conducting segments of aluminum disposed along square or rectangular contours, parallel to the edges of the sticker, between two layers of plastic. The device D furthermore comprises a capacitor 3 having flat plates 3*a*, 3*b* formed by metallic or aluminum-metallized surfaces, provided on either side of a sheet 4 of insulating plastic forming a dielectric layer. In the example of FIG. 2 the plates 3*a*, 3*b* are formed by square surfaces surrounded by the conductors of the inductor 2 which is linked in parallel, as illustrated diagrammatically in FIG. 3, to the plates 3*a*, 3*b* of the capacitor. The plates 3*a*, 3*b* are covered by an adhesive sheet of plastic 4*a*, 4*b*.

Figure 4:
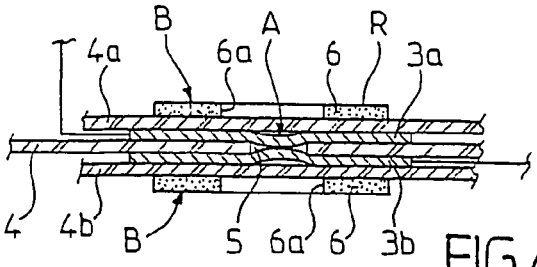
FIG. 4 shows, similarly to FIG. 3, the zone after punching.

At least one zone A is provided in the dielectric layer 4 so as to make it possible to establish a short-circuit between the plates 3*a*, 3*b* when the device D is subjected to a pulsed high-frequency emission produced by a deactivation apparatus. The zone A, in the example of FIG. 2, is situated at the center of the plates 3*a*, 3*b* and comprises a hole 5 (FIG. 4) in the layer 4. This hole 5 is formed during a punching of the plates 3*a*, 3*b* of the capacitor so as to place them in mechanical contact as illustrated in FIG. 4, but without establishing an electrical contact by reason of the insulating layer constituted by the layer of aluminum oxide present on the surface of the plates. As appropriate, a fusible material may be provided in a part of the zone A, without being in contact with the two plates.

Figure 3:
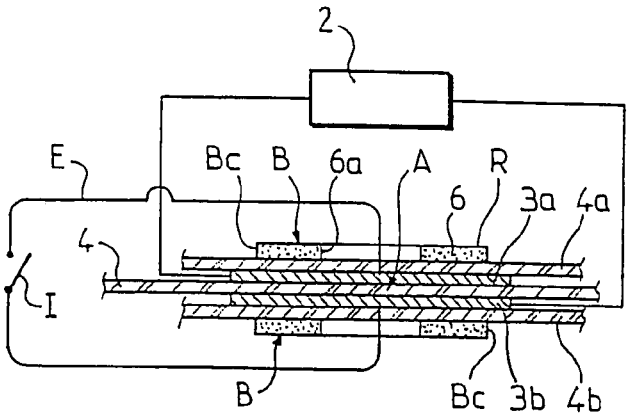
FIG. 3 is a partial diagrammatic vertical section on a larger scale, along the line III-III of FIG. 2, showing the device zone provided for deactivation before punching.

When the device D is subjected to the deactivation apparatus, heating and deoxidation occur in the zone A; the plates 3*a*, 3*b* weld together, with establishment of an electrical micro-contact and a short-circuit is established between them. In FIG. 3 the deactivation apparatus has been shown diagrammatically in the form of an electrical circuit E wired up to the plates; the circuit E comprises a breaker whose closure symbolizes the actioning of the pulsed emission causing the micro-welding of the plates 3*a*, 3*b* and the short-circuit.

According to the invention, at least one face of the substrate 1 comprises a rigidified part B whose contour Bc surrounds the zone A provided for deactivation. Preferably a rigidified part B such as this is provided on each face of the flat element 1 so as to surround the zone A.

The rigidified part B constitutes a rigid protection provided so as to ensure sufficient mechanical retention of the region surrounding the zone A in order to avoid bendings of this zone that are liable to cause the breakage of the electrical link after deactivation.

The part B may be constituted by a region of the substrate itself having undergone a rigidification treatment or having a specific composition endowing it with greater rigidity, or by an add-on rigidification element R fixed to the substrate.

The fixing of the rigidification element R to the element 1 is generally carried out by gluing so that the substrate 1 region situated inside the contour of the rigidification element R undergoes no stretching when the device D is subjected to bendings.

The rigidification element R may be made of resin, or of composite resin hardened when cold or under ultraviolet radiation.

Other examples of materials that are rigid enough to embody the element R comprise metallic materials, hard plastics, carbon, ceramic or composite materials. The thickness of the element R is small, of the order of a few tenths of a millimeter, for example 5/10 ths of a millimeter.

The rigidification element R may have the form of a ring or of a metallic or insulating panel, flat or domed and/or honed on its periphery.

In the example of FIG. 2, the element R is constituted by a rigid ring 6 centered on the zone A. The inside contour 6*a* of the ring surrounds the zone A. It is thus apparent that the region of the layer 4 comprising the zone A is retained by the ring 6 and will not be subjected to bending movements.

The inside diameter and the outside diameter of the ring 6 are chosen in such a way as to ensure sufficient mechanical retention of the zone A. In the nonlimiting exemplary embodiment of FIG. 2, the inside diameter of the ring is around 1 cm and the outside diameter is around 2 cm.

Figure 5:
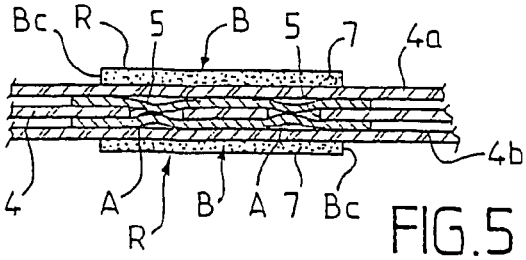
FIGS. 5 and 6 are diagrammatic sections of variant embodiments.

The element R may also be constituted by a flat panel 7 as illustrated in FIG. 5. In this variant, two zones A for the establishment of a short-circuit are provided in the layer 4. The contour of the panel 7 may be polygonal, in particular square, or circular.

Figure 6:
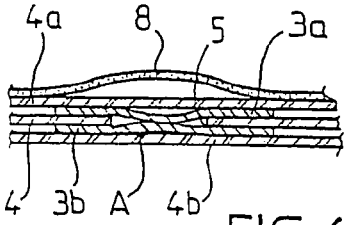

FIG. 6 shows another variant embodiment according to which the rigid protection panel 8 is domed, convex outward. The contour of the panel 8 surrounds the zone A and is fixed by gluing to the element 1. The domed part, distanced from the substrate 1, endows the panel 8 with good rigidity. According to the example of FIG. 6 a single panel 8 is provided on a face of the element 1. Of course it would be possible to provide two domed panels, one on each face.

FIGS. 7 to 10 relate to another variant of the device in the form of a sticker Da. This variant is especially advantageous for the insertion into a shoe sole. The sticker Da exhibits an ovoid contour with one end 9 narrower than the other end 10. The plates 3*a* and 3*b* of the capacitor are provided at the narrower end 9.

Figure 7:
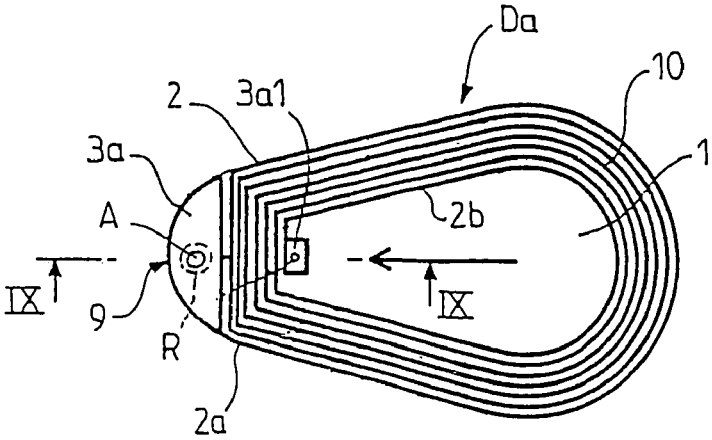
FIG. 7 is a plan view of a variant embodiment of the sticker.
Figure 8:
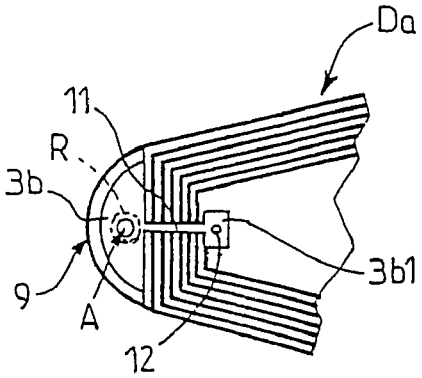
FIG. 8 is a partial view from below of FIG. 7.
Figure 9:
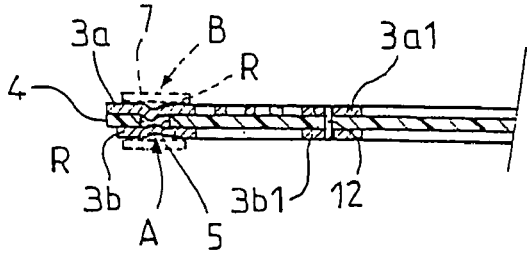
FIG. 9 is a diagrammatic partial section on a larger scale along the line IX-IX of FIG. 7.

The inductor 2, as visible in FIG. 7, is constituted by a winding of narrow conducting strips parallel to the contour of the substrate 1. The plate 3*a* of the capacitor, in the form of a sector of a circle, situated on a face of the substrate is linked to the outside strip 2*a* of the inductor. The inside strip 2*b* is linked electrically to a metallized surface, for example rectangular 3*a*1.

The other face of the substrate 1 comprises at the front a sector of a circle forming the plate 3*b* of the capacitor which is linked electrically by a conducting strip 11, substantially along the longitudinal axis of the substrate 1, to a metallized surface 3*b*1 in line with the surface 3*a*1. The surface 3*b*1 is linked electrically to the surface 3*a*1 through a hole 12 in the sheet 4.

The rigidification element R constituted by a ring 7 is disposed against the metallized surfaces 3*a*, 3*b*.

Figure 10:
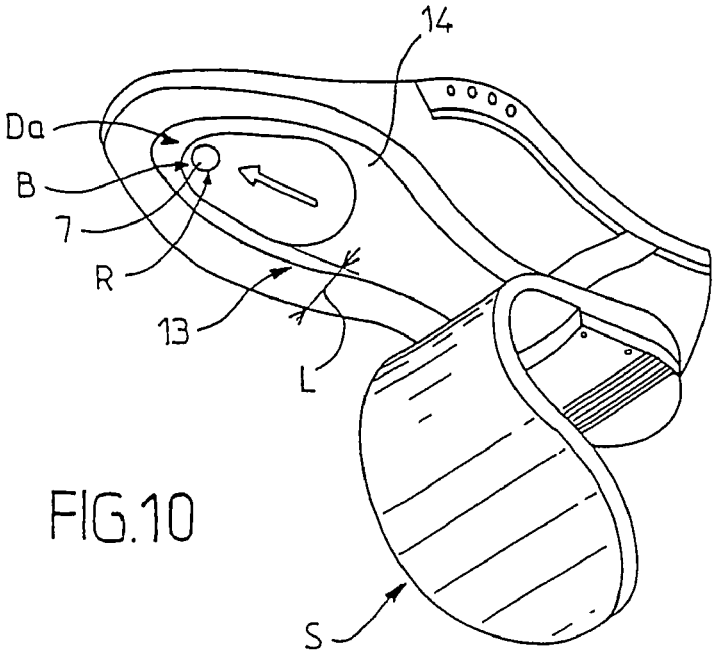
FIG. 10 is a perspective view, on a smaller scale, of a shoe sole where the sticker of FIG. 7 is currently being installed.

This sticker Da of ovoid form may be inserted toward the front of the sole of the shoe as illustrated in FIG. 10 while preserving a strip 13 having a width L of at least 2 cm for the gluing between the insole 14 and the sole S, toward the outside. The zone subjected to deactivation is situated on the plates 3*a*, 3*b* of the capacitor. This zone is located at the toe of the shoe, in front of the zone of natural creasing of the sole when walking. As a result, the elements involved in deactivation are less stressed in bending and the risk of deactivation is reduced.

The sticker Da of ovoid form optimizes the detection and the incorporation into the shoe.

The security device of the invention with the rigidification element R makes it possible to obtain dependable and permanent neutralization of antitheft protection by preventing the breakage of the short-circuit established between the plates 3*a,* 3*b* of the capacitor during deactivation.

The electrical contact or contacts establishing the short-circuit are protected by the rigidification element R against rubbing and movements, thereby preventing any risk of reactivation by breakage of the electrical link, in particular when the device D is used in a shoe sole.

The rigidification element R furthermore ensures protection of the capacitor against possible impairment by chemical products.

The invention claimed is:

1. A security device for preventing shoplifting comprising:

a flexible flat substrate comprising an inductor and a capacitor which form a resonant circuit, plates of the capacitor being separated by a layer of dielectric material at least one zone of which is designed to make it possible to establish a short-circuit between the plates for a deactivation of the device, wherein on at least one face of the substrate is provided a rigid part having a contour that surrounds the at least one zone provided for deactivation; and wherein the rigidity of the rigid part is such that the repeated bending movements of the flexible substrate are prevented or limited in the at least one zone where the short-circuits have been, or will be, established.

2. The device as claimed in claim 1, wherein a rigid part is provided on each face of the substrate, the contour of each rigid part surrounding the at least one zone provided for deactivation.

3. The device as claimed in claim 1, wherein the rigid part is constituted by a region of the substrate itself having undergone a rigidification treatment or having a specific composition endowing it with greater rigidity.

4. The device as claimed in claim 1, wherein the rigid part is constituted by an add-on rigidification element fixed to the substrate.

5. The device as claimed in claim 4, wherein the rigidification element is made of resin, or of composite resin hardened when cold or under ultraviolet radiation.

6. The device as claimed in claim 4, wherein the rigidification element is metallic.

7. The device as claimed in claim 4, wherein the rigidification element is constituted by a ring.

8. The device as claimed in claim 4, wherein the rigidification element is constituted by a flat or domed rigid panel.

9. The device as claimed in claim 1, wherein the device comprises a sticker having a contour of ovoid form with one end narrower than the other, the capacitor plates being provided toward the narrower end, such a sticker being insertable into the toe of the sole of a shoe, in front of the zone of natural creasing when walking.

10. The device as claimed in claim 2, wherein the rigidity of the rigid part is such that the repeated bending movements of the flexible substrate are prevented or limited in the zone or zones where the short-circuits have been, or will be, established.

11. The device as claimed in claim 2, wherein the rigid part is constituted by a region of the substrate itself having undergone a rigidification treatment or having a specific composition endowing it with greater rigidity.

12. The device as claimed in claim 1, wherein the rigid part is constituted by a region of the substrate itself having undergone a rigidification treatment or having a specific composition endowing it with greater rigidity.

13. The device as claimed in claim 2, wherein the rigid part is constituted by an add-on rigidification element fixed to the substrate.

14. The device as claimed in claim 1, wherein the rigid part is constituted by an add-on rigidification element fixed to the substrate.

15. The device as claimed in claim 5, wherein the rigidification element is constituted by a ring.

16. The device as claimed in claim 6, wherein the rigidification element is constituted by a ring.

17. The device as claimed in claim 5, wherein the rigidification element is constituted by a flat or domed rigid panel.

18. The device as claimed in claim 6, wherein the rigidification element is constituted by a flat or domed rigid panel.

19. A security device for preventing shoplifting, comprising:

a flexible flat substrate including an inductor and a capacitor forming a resonant circuit, plates of the capacitor being separated by a layer of dielectric material, at least one portion of the dielectric material being absent so as to enable a short-circuit between the plates for deactivation of the security device, and a rigid element on at least one face of said substrate, said rigid element surrounding said at least one portion for deactivation;

wherein the rigidity of the rigid element is such that the repeated bending movements of the flexible substrate are prevented or limited in the at least one portion for deactivation where the short-circuits have been, or will be, established.

* * * * *